US005904253A

United States Patent [19]

Cerullo et al.

[11] Patent Number: 5,904,253

[45] Date of Patent: May 18, 1999

[54] BELT SEPARATOR SYSTEM HAVING IMPROVED BELT GEOMETRY

[75] Inventors: Thomas Cerullo, Norwod; Charles E. Bozman, Natick; Thomas M. Dunn, Wilmington, all of Mass.

[73] Assignee: Separation Technologies, Inc., Needham, Mass.

[21] Appl. No.: 08/782,306

[22] Filed: Jan. 15, 1997

[51] Int. Cl.[6] ..... B03C 7/00

[52] U.S. Cl. ..... 209/128; 209/129; 209/130; 209/131

[58] Field of Search ..... 209/128, 129, 209/130, 131, 127.1

[56] References Cited

U.S. PATENT DOCUMENTS

| | | | |
|---|---|---|---|
| 2,689,648 | 9/1954 | Maestas | 209/131 |
| 3,096,277 | 7/1963 | Maestas . | |
| 3,635,340 | 1/1972 | Dunn | 209/130 |
| 3,720,312 | 3/1973 | Shook et al. | 209/130 |
| 4,451,357 | 5/1984 | LaVigne | 209/131 |
| 4,517,078 | 5/1985 | Inculet et al. | 209/128 |
| 4,839,032 | 6/1989 | Whitlock | 209/129 |
| 4,874,507 | 10/1989 | Whitlock | 209/11 |
| 5,006,226 | 4/1991 | Burt, Jr. | 209/130 |
| 5,484,061 | 1/1996 | Dunn | 209/129 |

FOREIGN PATENT DOCUMENTS

| | | | |
|---|---|---|---|
| 1007735 | 3/1983 | U.S.S.R. | 209/128 |
| 1475720 | 4/1989 | U.S.S.R. | 209/128 |

*Primary Examiner*—David A. Bucci
*Assistant Examiner*—Douglas Hess
*Attorney, Agent, or Firm*—Wolf, Greenfield & Sacks, P.C.

[57] ABSTRACT

In a belt separator system for separating constituents of a mixture of particles, the belt having a leading deflective surface at an acute angle to the direction of belt travel so as to impart a transverse momentum component to the constituent in a direction toward a longitudinal centerline of the belt separator system.

25 Claims, 6 Drawing Sheets

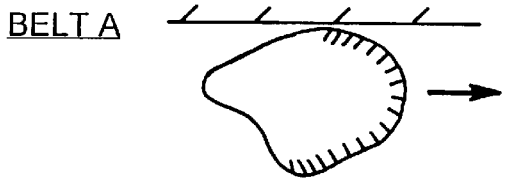
Fig. 5A
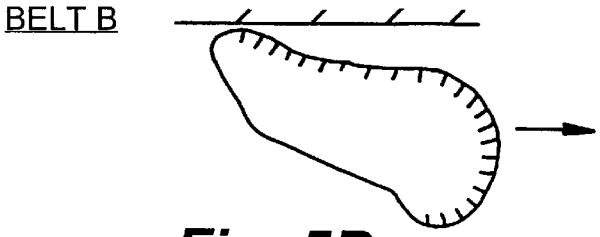
Fig. 5B
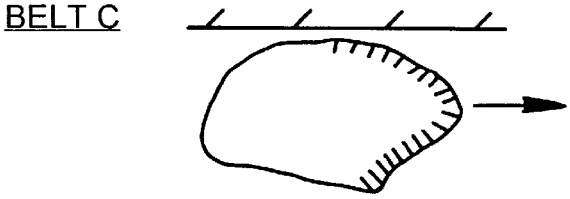
Fig. 5C
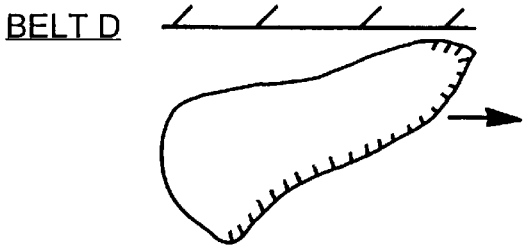
Fig. 5D
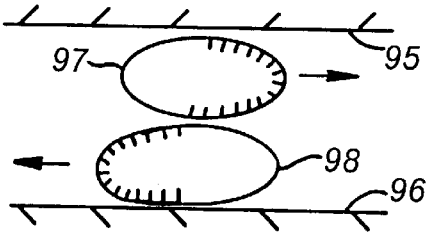
Fig. 5E
Fig. 5

BELT SEPARATOR SYSTEM HAVING IMPROVED BELT GEOMETRY

FIELD OF THE INVENTION

The present invention relates generally to a belt separation apparatus utilizing a movable belt to separate a particle mixture based on charging of the particles, and more specifically to an improved belt geometry for imparting a transverse momentum component to the particles for increased yield, throughput and/or purity of separation.

BACKGROUND OF THE INVENTION

Belt separator systems (BSS) are used to separate the constituents of particle mixtures based on the charging of the different constituents by surface contact (i.e., the triboelectric effect). FIG. 1 shows a belt separator system 10, such as disclosed in U.S. Pat. Nos. 4,839,032 and 4,874,507, which are hereby incorporated by reference in their entirety. Belt separator system 10 includes parallel, spaced electrodes 12 and 14/16 arranged in a longitudinal direction defined by longitudinal centerline 25 and belt 18 traveling in the longitudinal direction between the spaced electrodes. The belt forms a continuous loop which is driven by a pair of end rollers 11, 13. A particle mixture is loaded onto belt 18 at feed area 26, between electrodes 14 and 16. Belt 18 includes counter-current traveling belt segments 17 and 19 moving in opposite directions for transporting the constituents of the particle mixture along the lengths of the electrodes 12 and 14/16.

An electric field is created in a transverse direction between electrodes 12 and 14/16 by applying a potential to electrode 12 of polarity opposite to a potential applied to electrodes 14/16, e.g., electrode 12 has a positive potential, and electrodes 14/16 have a negative potential. As the constituents of the particle mixture are transported along the electrodes by belt 18, the particles become charged and experience a force in a direction transverse to longitudinal centerline 25 of system 10, due to the electric field. When electrode 12 is positively charged and electrodes 14/16 are negatively charged, the electric field moves the positively charged particles toward electrodes 14/16 while the negatively charged particles move toward electrode 12. Ultimately, each particle is transferred toward one of product removal section 24, and reject removal section 22, depending upon the sign of charge of the particular particle as well as the sign of charge of the electrodes.

The charge that a particle develops determines the polarity of the electrode to which it will be attracted, and, therefore, the direction in which belt 18 will carry the particle. This charge is determined by the relative electron affinity of the material—a function of the energy needed to remove an electron from the surface of the particle (i.e., the work function of the particle). When two particles contact, the particle with the higher work function gains electrons and becomes negatively charged, while the particle with the lower work function loses electrons and becomes positively charged. For example, mineral oxide particles have relatively high work functions, and coal species have relatively low work functions; thus, during separation of these two particles in system 10, the coal becomes positively charged while the mineral oxide becomes negatively charged.

Typically, when separating mineral oxide particles from coal, system 10 is arranged such that belt 18 moves in a counter-clockwise direction as shown in FIG. 1. Electrodes 14/16 (adjacent belt segment 19) are at negative potential, and electrode 12 (adjacent belt segment 17) is at positive potential. With this arrangement, the positively-charged coal particles are moved to the product removal section 24 by belt section 19, while the negatively-charged mineral oxide particles are moved to the reject removal section 22 by belt section 17.

It is possible to operate belt system 10 in three other modes by varying the travel direction of the belt and/or the polarity of the electrodes. In a second mode of operation, belt 18 moves clockwise with electrode 12 at a positive potential and electrodes 14/16 at a negative potential. In a third mode of operation, electrode 12 is at a negative potential and electrodes 14/16 are at a positive potential with belt 18 moving counter-clockwise. In a fourth mode of operation, electrode 12 is at a negative potential and electrodes 14/16 are at a positive potential with belt 18 moving in a clockwise direction. Generally, for positively-charged product particles, the first operational mode is preferred, while for negatively-charged product particles the third mode of operation is preferred.

Another important feature of the belt-type electrostatic separator is the ability of the belt to sweep the electrodes clean and thus prevent the adherence of layers of material on the electrodes. In this regard, the belt undergoes substantial frictional forces due to contact with the particles, electrodes and oppositely traveling belt segment, and is stretched substantially taut in the longitudinal direction (between the end rollers) during use. This leads to wear of the belt which can adversely affect the quality of the separation over time.

The two effects caused by the belt, transporting material and sweeping the electrodes clean, are both known to be important to the quality of the separation. When the electrodes are uncharged, the geometry of system 10 is generally symmetrical about centerline 25 since belt 18 creates a symmetrical flow field parallel to and within the electrodes. However, when the electrodes are charged with opposite polarity as discussed above, an asymmetry is introduced in this system 10. Furthermore, the charging of the components of the particle mixture creates an asymmetry. It is these two asymmetries that results in the electrostatic separation of components having dissimilar charge.

Typically, it is presumed that symmetrical effects, i.e., those that affect particles irrespective of their electrostatic charge, would not yield asymmetric results, such as improved separation. However, surprisingly it has been found according to the present invention that what may be considered a symmetrical change has produced a significant positive effect on the quality of the separation.

SUMMARY OF THE INVENTION

According to the present invention, a belt separator system is provided for separating constituents of a mixture of particles. In one embodiment, the system includes parallel, spaced first and second electrodes arranged on opposing sides of a longitudinal centerline, which establish an electric field in the space between the electrodes. A belt, with counter-current traveling belt segments, is movable longitudinally between the first and second electrodes and has a leading deflective surface. The deflective surface contacts the constituents of the mixture of particles and imparts a transverse momentum component to the constituents in a direction toward the longitudinal centerline.

In a specific embodiment, the leading deflective surface forms part of a substantially open transport belt that travels longitudinally between the electrodes and contacts the particles within the separator system. The leading surface forms a substantially acute angle overall with respect to the direction of belt travel, for example in the range of 10 to 60°, and more preferably 15 to 45°. Surprisingly, it has been found that the stability of the system over time is substantially improved such that there is no significant degradation of the yield and purity of the separation after extended operation.

A method is also provided for separating the constituents of the mixture of particles with a belt separator system, which includes the step of contacting the constituents with a leading deflective surface to impart a transverse net momentum component to the constituents toward the longitudinal centerline of the system.

In a broad sense, the invention is a method of separating different components of a mixture in a separation chamber comprising the steps of:

a. admitting said mixture into the separation chamber, said separation chamber having means defining confronting surfaces spaced more closely than the respective lengths of said confronting surfaces;

b. impressing a separation influence toward at least one of said confronting surfaces of said separation chamber;

c. separating said different components in the direction of said separation influence according to their relative influenceability to said separation influence;

d. mechanically moving components of like net influenceability near each other transversely to said separation influence, said streams being in communication parallel to said separation influence so as to transfer a portion of at least one of said components to another of said respective streams by virtue of the continued action of said separation influence as said streams progress transversely to said separation influence;

e. removing separated streams from said separation chamber;

wherein said streams are mechanically moved by an endless transport belt, said belt having transverse leading deflective surfaces.

These and other features and benefits of the present invention will be more particularly understood from the following detailed description.

BRIEF DESCRIPTION OF THE FIGURES

FIGS. 5A–5E is a schematic illustration comparing the belt geometry of the prior art to the belt geometry of the present invention;

DETAILED DESCRIPTION

Figure 1:
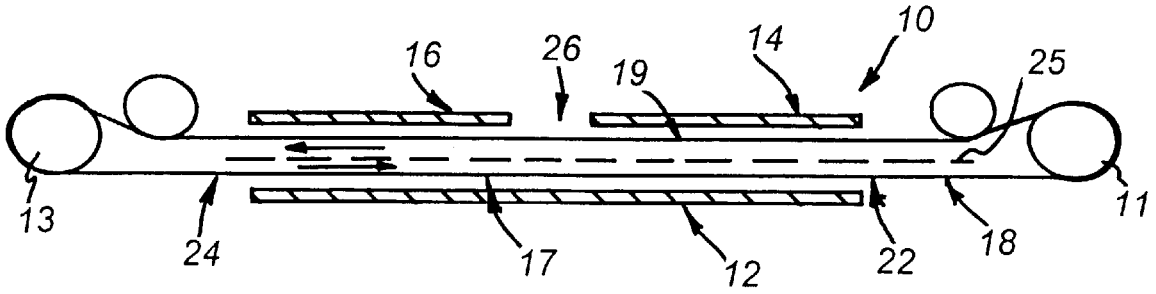
Fig. 1 (PRIOR ART)
FIG. 1 is a side sectional view showing the general configuration of the known belt separator system.

The present invention is directed to an improved belt for use in an electrostatic separation process, the belt having desirable geometric features that provide one or more of:

higher process stability over time;

reduced sensitivity of process performance to belt speed and electrode gap;

higher yields at higher purities.

In the following discussion, the process performance may be defined with respect to one or more of the following three attributes:

yield: the fraction of a specified component of the input stream which is recovered in the product stream;

purity: the percentage of the multi-constituent product stream that is constituted of the desired constituent; and throughput: the mass or weight per hour of multiconstituent feed entering the separator.

These parameters are interrelated through conservation of matter considerations.

In the triboelectric separation process previously discussed, the region between the electrodes is where mixtures of feed constituents are separated. Commonly, one or more of the constituents of the feed is stripped (reduced) in the product and is enriched (increased) in the waste stream. The electrode spacing may influence the sharpness of separation, yield and throughput. The electrostatic field between the electrodes, in volts per mil of gap, is the primary driving force that causes separation. However, there are practical limits on how high a voltage may be established between the electrodes. As a result, while a larger belt gap allows higher throughput rates, the electric field intensity drops when the gap is widened (at constant electrode voltage) and there are practical limits on how wide the gap may be set.

The belt acts as a drag conveyor of particles. The potential throughput limit is determined by the belt speed, the width of the gap, and the drag of the belt on the fluidized particles. At large gaps, the particles must traverse the region from the electrode surface to the longitudinal centerline of the system in order to get to the proper product stream (feed or waste). The rate at which the particles can travel across this distance is limited by their electrical mobility (and their mass). At larger and larger gaps, more and more particles cannot traverse this distance before being conveyed into the wrong hopper. As a result, the quality of separation deteriorates.

However, in accordance with the present invention, a belt is provided that facilitates the transport of particles to the longitudinal centerline. This enables wider electrode gaps to be used, resulting in higher throughput rates.

An important consideration in a commercially-viable belt separation system is the usable lifespan of the belt. Ideally, the process utilizes a long-lived belt which, throughout the period of use, allows unattended processing of material feed streams, provides consistent quality and rate of separation during this time, is tolerant of a wide variability in feed streams, and can process very high quantities of feed—thus providing a very low belt cost per ton of material processed. This goal has been difficult to reach with prior art belts.

Belts have been fabricated from a variety of materials using a variety of processes. Generally, the prior art belt has been comprised of woven fabrics, joined into an endless belt through adhesive bonding, heat welding or other methods. These belts generally perform equivalently when run in either the forward or reverse belt travel directions.

The prior known belts have exhibited a number of limiting characteristics such as:

short belt-life because of abrasive wear;

decline in the separating power of the belt over time (i.e., "process instability"); and inability to process different types of feeds.

For example, of considerable commercial importance is a process for stripping unburned carbon from fly ash (a byproduct of the power-generating industry). In this regard, a "difficult" feed may contain a very high percentage of unburned carbon in the ash; this feed has required the use of a very small gap between the electrodes, very low feed rates, higher operating electrode voltage, or a combination thereof. In many instances when feeds of this type are processed, the results are low product yields and unattractive process economics. If the belt speed is increased during processing of such "difficult" feeds, belt wear and service life may be adversely affected as well.

All of these problems have limited the use of known belt separator systems. With existing belts, occasional to frequent process operator intervention (i.e., adjustment of electrode gap, belt speed, feed rate, operating voltage, etc.) has often been necessary to maintain consistent separating performance. However, hands-off operator-free operation of the belt separator system is highly desirable, since it would allow either reduced labor or the use of low-skill labor, which would reduce the cost of the operating process.

The present invention provides a belt with desirable geometric characteristics to address the above problems. Generally, it enables a more effective separation, resulting in higher purity products at higher yields. It may also provide better process stability, i.e., consistency of separation over time with use of the belt. It may also provide reduced belt wear and longer belt life. It may provide less dependence of the process on electrode gap setting and on the belt speed. In addition, it may enable the processing of materials with higher electrode gaps, to enable higher material processing rates and reduced operating cost per ton of processed material for a given machine size.

The desirable geometric characteristics of the belts are defined herein as "leading deflective surfaces", which are situated on belt elements and are not aligned with the direction of motion of the belt. Such surfaces have an overall net transverse component, with regard to the direction of belt travel, and are hereafter termed "transverse" elements for convenience. Such elements lie at an acute angle to the plane of the belt. A zero angle places the leading surface in the plane of the belt. A 90° angle places the leading surface normal to the plane of the belt. Angles in between aim the leading surface in the direction of belt travel, but at intermediate positions between these two extremes.

A wide variety of belt configurations can provide leading deflective surfaces. However, they have in common the effect of directing particles away from the electrode surfaces towards the region between the counter-current traveling belt segments. They all impart a transverse component of velocity, i.e., in a direction normal to the plane of the electrodes. By comparison, previous state-of-the-art belts induce particles to move parallel to the direction of belt travel.

Belts with leading deflective surfaces do not provide the same level of performance if the belt is made to travel in the forward and reverse directions. Specifically, belts with leading deflective surfaces provide dramatically improved performance when the leading surfaces are "aimed" in the direction of belt travel, while performance characteristics with the belt traveling in the opposite direction are not improved or are typical of the belts of the prior art. An analogy can be drawn to snow plows, which function best only when the configuration of, and the direction of travel of the leading surface, with respect to the plowed surface are both considered.

Belts with leading deflective surfaces may enhance belt separation performance for a number of reasons; potential reasons include:

scraping of the electrode surfaces, cleaning them, and thus enhancing the effect of the imposed electric field on the particles between the electrodes;

hydrodynamic forces generated when the belt travels at high velocities, which impart forces on the particles traveling through the separator so that they move particles from the electrode surfaces to the region between the counter-traveling belt segments, where the electrostatic separation is most effective; and hydrodynamic forces generated at high belt velocities that cause the two counter-traveling belt segments to separate (or "bow") away from the centerline of the system, thus reducing the frequency of their mutual contact.

Figure 2:
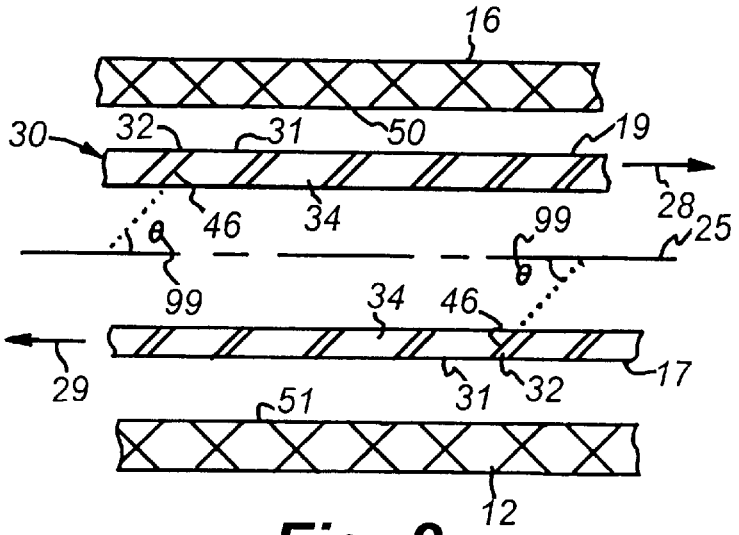
FIG. 2 is an enlarged partial sectional view of a belt separation system similar to FIG. 1 but utilizing a belt having an improved belt geometry according to the present invention.

FIG. 2 is an enlarged partial sectional view of a belt separator system similar to FIG. 1, but utilizing a new belt 30 of the present invention. A top plan view of a portion of the belt is shown in FIG. 3A, and a cross-section showing the leading deflective surface is shown in FIG. 3B.

More specifically, an upper belt segment 19 travels to the right (in the direction of arrow 28) adjacent upper electrode 16. The belt has an upper surface 31 which, although shown spaced from upper electrode surface 50, is often in contact with surface 50. Similarly, a lower belt segment 17 travels in the direction of arrow 29, adjacent lower electrode 12. Again, the lower surface 31 of belt segment 17 is often in contact with surface 51 of electrode 12.

Figure 3A:
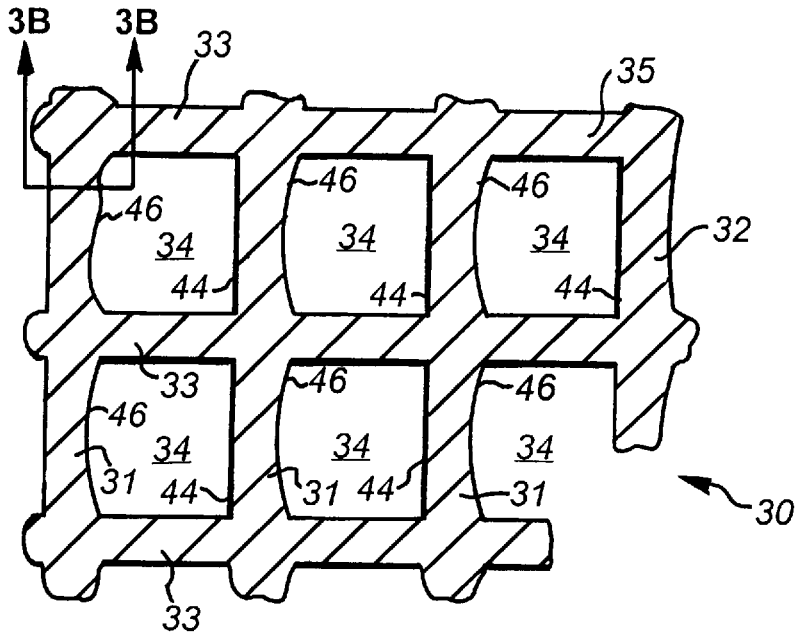
FIG. 3A is a top view of a portion of the new belt according to the present invention.

FIG. 3A is a top view showing the top surface 31 of a portion of the belt, which would engage the electrode surfaces 50 and 51. The belt is formed as a substantially rectangular open grid or square matrix with parallel spaced segments 31 and substantially transverse therewith, parallel spaced intersecting segments 33. The square openings are spaces 34 between the intersecting segments 31 and 33 to enable the particles to move through the belt toward the longitudinal centerline 25 of the system. The segments 31 define a leading deflective edge 46 according to the present invention which, as shown in FIG. 2, forms a substantially acute angle θ (labeled 99) with respect to the longitudinal centerline 25, in the direction of belt travel (shown by arrows 28 or 29). It is these surfaces 46 which act to clean the electrode surfaces 50 and 51 and impart a transverse momentum component to the particles towards centerline 25.

Figure 3B:
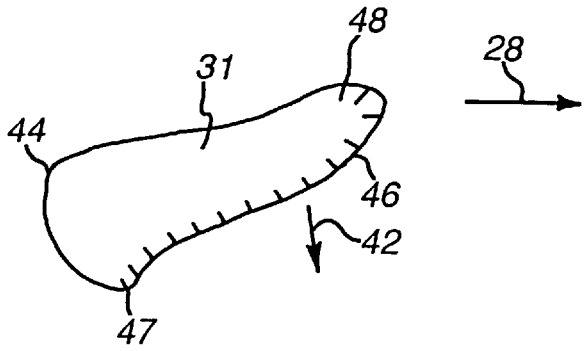
FIG. 3B is a cross-sectional view taken along the section lines 3B—3B in FIG. 3A.

FIG. 3B shows more specifically a particular cross-section of belt segment 31, wherein the deflective leading surface 46 extends from a lowermost point 47 to an uppermost point 48, and wherein short lines along the leading deflective surface 46 suggest the momentum component transfer to the particles by the leading (contact) surface 46. Opposite the leading surface 46 is a trailing surface 44. Although the angle of leading surface 46 with respect to the direction of belt travel (28 in FIG. 3B) varies along the length of surface 46, there is an overall net transverse component shown by arrow 42 transverse to the direction of belt travel 28. This will be described below in greater detail with respect to FIG. 5.

Figure 4:
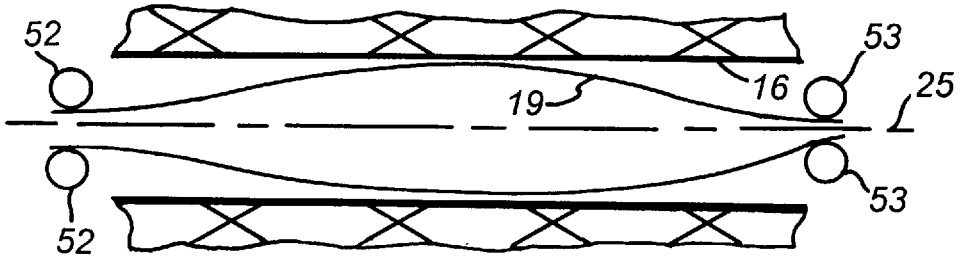
FIG. 4 is an enlarged partial sectional view similar to FIG. 2 but showing bowing of the counter-current traveling belt segments.

FIG. 4 illustrates the above referenced hydrodynamic forces which may cause the counter-traveling belt segments to separate or bow away from the longitudinal centerline 25, in order to reduce the frequency of contact between the belt segments and thus reduce wear. FIG. 4 is similar to FIG. 2 but shows that, between pairs of end rollers 52 and 53, the upper and lower belt segments 19, 17 bow away from centerline 25 and toward electrode surfaces 50 and 51.

More specifically, it is generally known and reported that, as is true for nearly all materials in general, plastic-to-plastic wear (i.e., plastic belt segment 19 wearing against plastic belt segment 17) occurs much more rapidly than plastic-to-dissimilar material wear, e.g., plastic belt segment 19 wearing against non-identical electrode material of electrode 16. For belt separator systems, the endless loop configuration of the belt necessarily results in a situation where plastic-to-plastic wear, should it occur, produces a wear rate greater than that of belts-to-electrode wear. A well-recognized physical characteristic of wear is that it is dependent on the product of contact pressure and sliding velocity. In particular, depending on the mechanism of wear, the wear rate of a given material (weight of removal) may depend on the product: $P^aV^b$, where P is pressure and V is the relative velocity of the two sliding materials. The exponents a and b are one or more, depending on the mode of wear.

Thus, the consequences of excessive belt plastic to belt plastic contact in the belt separator system can produce dramatically high wear rates and short belt life. Because the belt geometry of the present invention enables the counter-traveling belt segments to move away from each other in use, the belt may experience reduced plastic-to-plastic wear and therefore exhibit a longer lifetime.

There are various methods to experimentally verify the benefits of the superior belt geometry of the present invention, including:

- one way is to provide the belt separator system with a constant feed stream at a constant feed rate, then to change belt types, and look for sharper separations and higher product yield in the processing of the materials;
- a second way is to measure the quality of separation over the life of the given belt, and determine whether yields or separation suffer degradation or are consistent over time;
- a third way is to observe cleaner electrodes, due to the moving belt more effectively sweeping particles from the surface and thereby infer better separation;
- a fourth way is to define a desired purity of product from the separation for a process with a given belt, then to install another belt to determine whether there is an increase in the material processing rate;
- a fifth way is to establish the maximum amount of impurity (constituent to be stripped) in a given feed, process such a feed stream using an existing belt so as to achieve a defined product purity, change the belt, and then determine whether a higher level of impurity can be accommodated in the feed; and
- a sixth way is to determine the service life of belts (given that the sharpness of separation, yield and throughput are approximately equal).

The graphs set forth in FIGS. 6–8 and discussed in the following examples show how the improved geometry belt of this invention provides these benefits.

Example 1

The belt of the present invention provides for a more stable operation of a belt type electrostatic separator in laboratory operation, compared to isotropic belts of the prior art. In FIG. 6 is shown a graph of the impurity content of the product produced during a series of test runs with four different belts. Each symbol represents the analysis of the product produced from a single test. The two axes are the cumulative mass of material processed and the impurity content of the purified product. The tests were on a pilot scale separator and were performed so as to replicate the operating conditions of a full scale separator as closely as possible. The four lines represent the cumulative trend of the purity level of product as it changes with time.

A schematic cross section view of two representative counter-current belt segments 97/98 traveling in opposite directions between upper and lower electrodes 95/96, is shown in FIG. 5E, with the leading (contact) surface shaded. Cross sections of the four belts A, B, C and D tested are shown in FIGS. 5B–5D, respectively. Belts A and C are two belts of the same material, but operated in different orientations. Similarly, Belts B and D are the same material but operated in two different orientations. The geometry of A, B and C are similar, in that the leading surfaces are substantially rounded and provide a blunt obtuse leading surface in the direction of motion of the belt. Belt D by contrast provides a deflective leading surface that deflects particles away from the region near the electrode and toward the central part of the separator.

Figure 6:
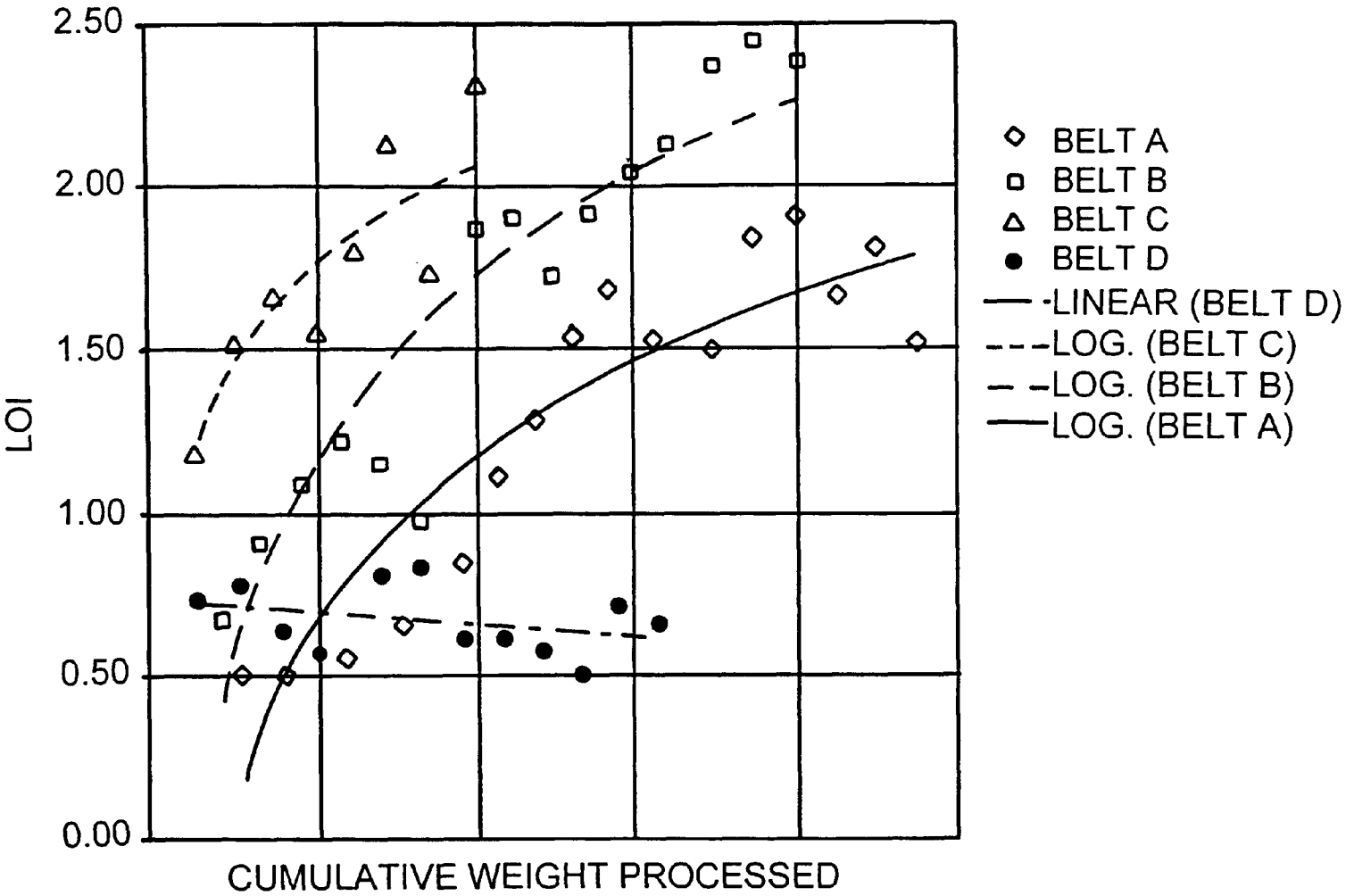
FIG. 6 is a graph of the impurity content of the separation product as a function of cumulative weight processed, comparing the results for a belt with and without a deflective surface according to the present invention.

The four lines in FIG. 6 clearly show substantial differences between the different belts. The belts (A–C) with the blunt leading surface all show substantial degradation of separation with time. Belt D, with the acute leading surface shows no such degradation, but instead shows a slight improvement, although the scatter in the data makes any such improvement hard to interpret. The lack of degradation is readily apparent and holds quite strongly over the approximately 50 test runs that are represented by this graph.

The tests were performed by carefully preparing individual samples of flyash from the same source collected at the same time and stored under controlled conditions until the tests were performed. Samples were individually prepared and weighed prior to performing the test. The tests were performed on a pilot scale separator with special attention paid to keeping the feed rate, belt speed, electrode voltage and other relevant parameters the same within operating tolerances for the various tests. The tests were performed by trained operators who have performed many hundreds of similar tests. The samples produced were analyzed and checked for reliability. The differences between the improved belt D and the others is quite significant and not an experimental artifact.

Example 2. Dependence of Separation Effectiveness On Electrode Gap

Figure 7:
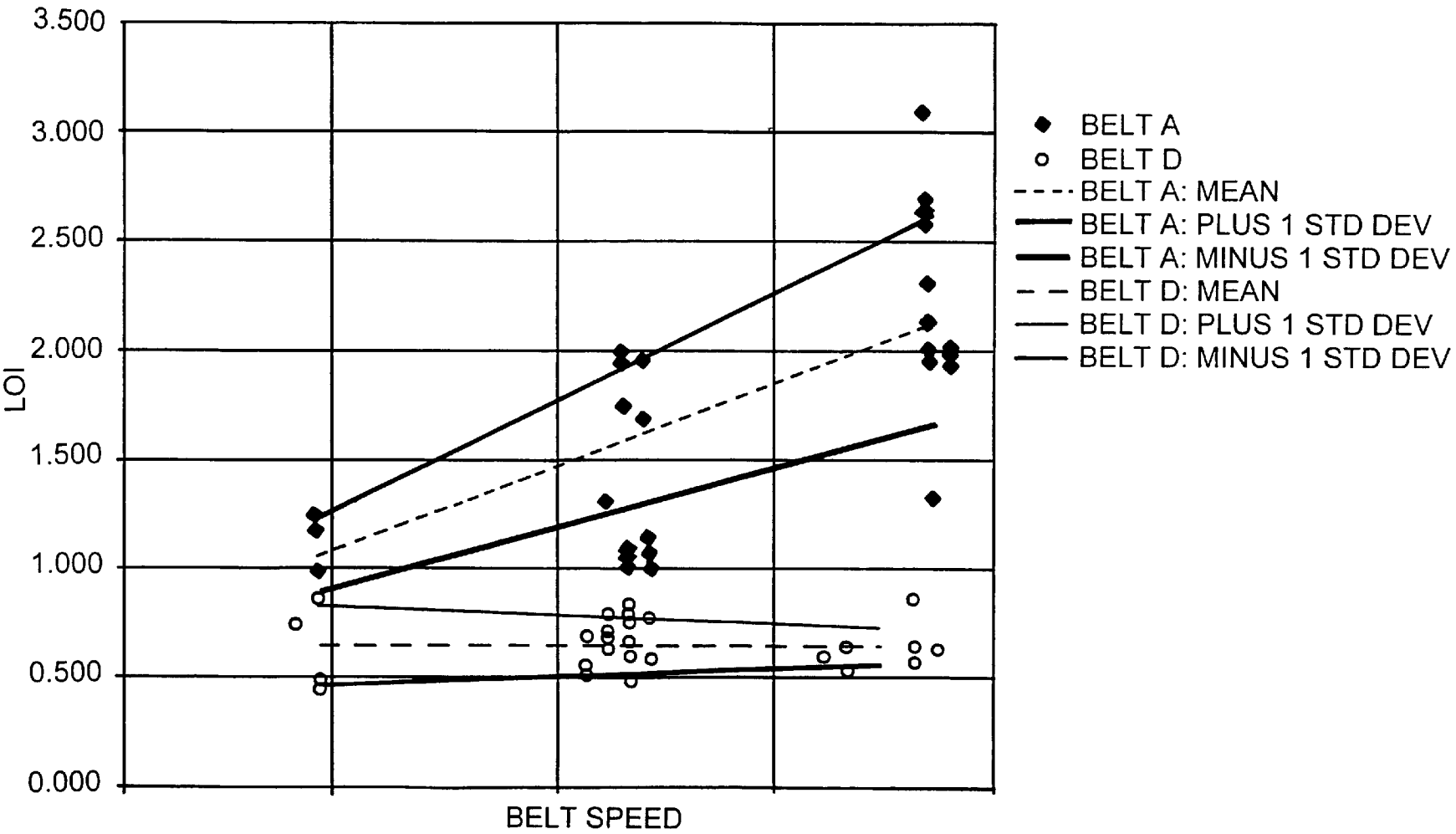
FIG. 7 is a graph of the impurity content of the separation product as a function of belt speed, with a gap space of 0.380 inches between the electrodes, for a belt with and without a deflective surface according to the present invention.
Figure 8:
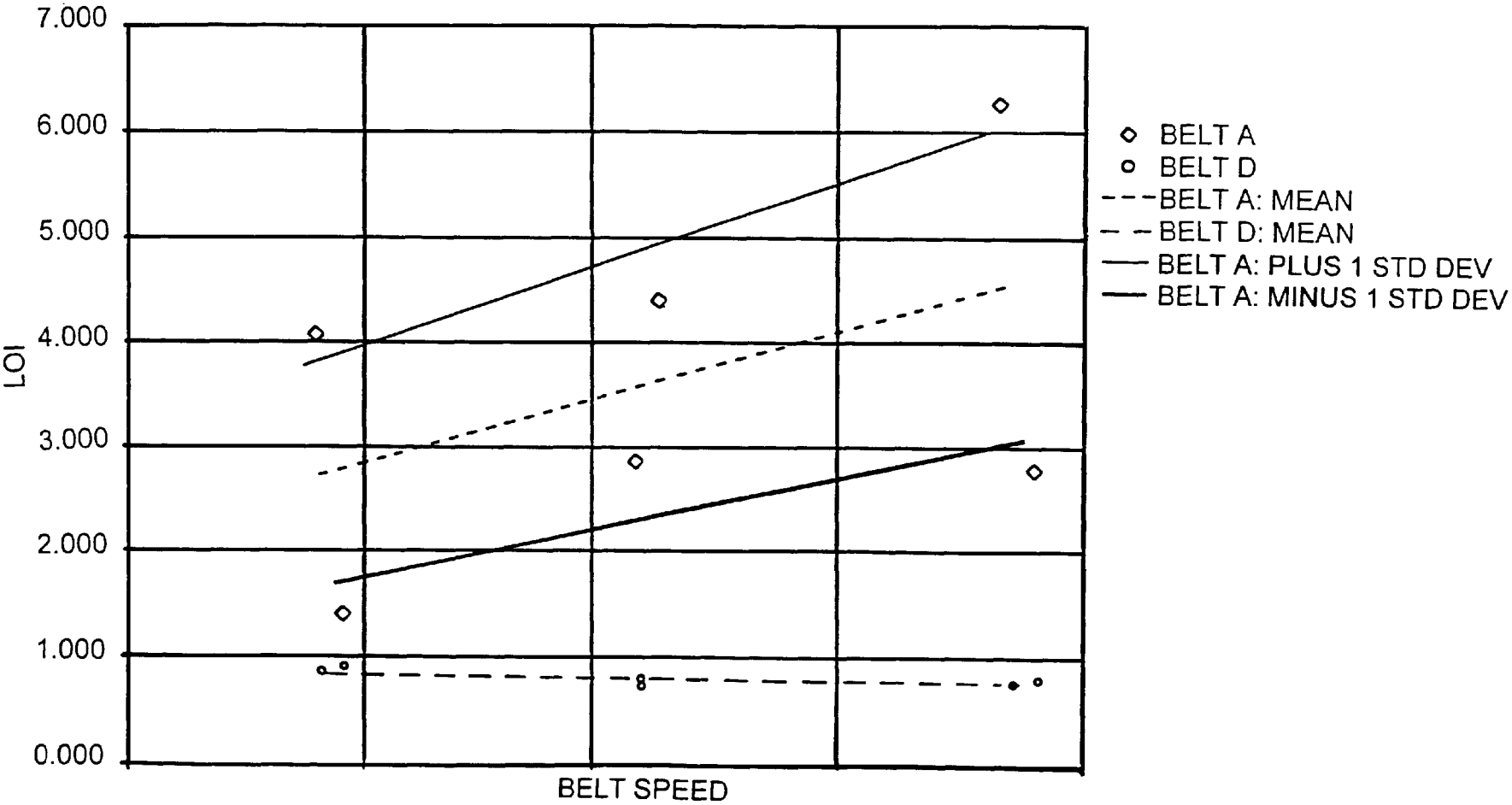
FIG. 8 is a graph of the impurity content of the separation product as a function of belt speed, with a gap spaced between electrodes of about 0.420 inches, for a belt with and without a deflective surface according to the present invention.

FIGS. 7–8 show the results of a number of tests using belts of the present invention (belt D) and belts of the prior art (belt A), and demonstrates a number of improvements in the stability of the process. FIG. 7 compares many tests using belts of the present invention with belts of the prior art at an electrode spacing of 0.380 inches. The lines drawn in the figure are fitted to plus/minus one standard deviation from the mean of the product purities at the various speeds. FIG. 8 compares a total of 12 tests of the two belts at an electrode spacing of 0.420 inches. The lines are fitted to the three high and the three low points of each of the two types of belts. A number of conclusions can be drawn.

1. With the improved belt D, product purity is less dependent on the speed of the belt.

2. With the improved belt D, product purity is less dependent on the spacing between the electrodes.
3. There are a number of variables that are not shown in the graph that did vary, and are a source of some of the variability in performance between the various runs shown. It is apparent that the variability with belt D is much less than with belt A. Some of the other variables which show reduced influence include feed rate, humidity, position of feed point, clearance between the belt and the electrode, contamination of belts, and amount of impurity present in the feed material.
4. Belts of the present invention provide for less variability in process performance due to known and unknown variables.

Belts of the present invention show improved process stability for essentially all variables that have been measured. There are still unknown factors that influence the separation, and it would seem that the reduced scatter in the performance of belt D results from a reduced dependence on the variables that are not controlled for.

It should be noted that as any belt is used, it will wear and the clearance between the belt and the electrodes will change. As this clearance changes it is desirable for the performance of the separator to not change. Belts of the present invention show better process stability in the presence of belt wear than belts of the prior art.

The data used in this example are from the separation of unburned carbon from flyash. The improvement in process stability is so striking, and with so many different parameters, that this improved stability is expected to apply to virtually all other separation types as well, including separating impurities from minerals such as acid insoluble minerals from carbonates, colored minerals from carbonates and talc, ash and sulfur bearing minerals from coal, iron bearing minerals from glass making raw materials, alkali removal from cement making raw materials, iron bearing minerals from ceramic precursors, wheat flour from wheat bran, etc.

Example 3

Table 1 set forth below illustrates the performance of the two types of belts on a commercial-scale separator separating flyash at about 20 tons per hour. These values represent averages over time of the results of long term operation on many belts of both types. As before, belt A is a belt of the prior art, and belt D is a belt of the present invention. It can be readily seen that belt D provides improved separation. Starting with a feed ash with higher LOI (Loss On Ignition, a measure of unburned carbon) the belt of the present invention produces a cleaner product (less carbon), a more concentrated reject (more carbon), and higher yield (more product). This improvement in performance is manifest in a number of aspects of separator performance. This table demonstrates the improved performance of the new belt for long-term operation. This series of tests resulted from the processing of many thousands of tons of flyash.

TABLE 1

| | Typical Fly Ash Processing | | | | |
|---|---|---|---|---|---|
| | # belts | Feed LOI | Ash LOI | Carbon LOI | Yield |
| Belt A | 25 | 5.88 | 1.46 | 16.61 | 70% |
| Belt D | 26 | 7.13 | 1.22 | 31.88 | 80% |

The belt used in the present invention may be any conveyor or transporting article having leading deflective surfaces which contact the particles to be separated. The belt must have openings through which the particles can pass, and should be made of a substantially non-conductive material such as plastic, fabric, rubber, etc. The belt may be formed as a woven article, molded, or extruded.

The belt may also be fabricated of individual components which can be selected for their individual properties. For example, longitudinal elements may be selected for tensile strength and creep resistance, while transverse leading deflective elements may be selected for their wear resistance and stability upon exposure to erosive contact with particulate streams. The tensile elements may be fibers such as aramid or polyester coated to provide improved abrasion resistance. The transverse elements may be ultra-high molecular weight polyethylene which exhibits good wear resistance to particle erosion.

The leading deflective surfaces may be relatively stiff and non-deformable members. Alternatively, the leading surfaces may deform at belt speeds, resulting in the desired geometry at the time of use. Thus, a belt may or may not exhibit desirable geometry when at rest, which is at the time of installation on a machine.

Further, not every cross-direction strand needs to exhibit the desirable leading deflective surface geometry.

Experimental results show that, even though desirable geometry belts do experience considerable wear during use in belt separator systems, sometimes severely so, the desirable acute angle leading deflective surface geometry is maintained throughout the period of belt usage.

It is expected that belts of the present invention will also improve operation of belt type separation processes utilizing other separation influences as described in U.S. Pat. No. 4,874,507 (incorporated by reference in its entirety) including electrophoretic separation of liquids, the magnetic separation of particles, the shear gradient separation of particulates, etc.

Having thus described particular embodiments of the present invention, various modifications and improvements may readily occur to those skilled in the art, and are intended to be part of this disclosure.

We claim:

1. A belt separator system for separating constituents of a mixture of particles, the belt separator system comprising:

a first electrode and a second electrode arranged on opposite sides of a longitudinal centerline and having an electric field provided between the first and second electrodes;

a belt permeable to the constituents of the mixture of particles, the belt conveying constituents of the mixture of particles, having like net influenceability to the electric field, in respective counter-current streams along a longitudinal direction between the first and second electrodes; and the belt having a leading deflective surface at a plurality of locations on the belt that contact the constituents of the mixture of particles and impart a momentum component to the constituents in a direction transverse to the longitudinal direction of the belt separator system.

2. The system of claim 1, wherein the leading deflective surface is made of a wear-resistant electrically non-conductive material.

3. The system of claim 1, wherein the leading deflective surface is made of a material which includes polymerization products from at least one olefinic monomer.

4. The system of claim 1, wherein the leading surface is made of a material which includes one or more polymerization products from the group consisting of fluoropolymers and polyamides.

5. The system of claim 1, wherein any point on each leading deflective surface forms an angle with respect to the direction of belt travel in a range from 10–60°.

6. The system of claim 5, wherein the angle is in a range from 15–45°.

7. The system of claim 1, wherein the belt includes counter-current belt segments traveling in opposite directions along the longitudinal direction.

8. The system of claim 7, wherein any point on each leading deflective surface forms an angle with respect to the direction of belt travel which is selected to reduce contact between the counter-current belt segments.

9. The system of claim 7, wherein the counter-current belt segments bow away from the longitudinal centerline.

10. The system of claim 1, wherein the mixture of particles separated is selected from the group consisting of: carbon from flyash, acid insoluble minerals from carbonates, colored minerals from carbonates and talc, ash and sulfur bearing minerals from coal, iron bearing minerals from glass-making raw materials, alkali from cement-making raw materials, iron bearing minerals from ceramic precursors, and wheat flour from wheat bran.

11. The system of claim 1, wherein any point on each leading deflective surface forms an angle with respect to the direction of belt travel which is selected to accomplish one or more of:

maximizing throughput of the belt separator system;

maximizing processability over time of the belt separator system; and maximizing the ability to separate a particular mixture of particles.

12. The belt separator system of claim 1, wherein the constituents of the mixture of particles moved by the leading deflective surface of the belt are moved in the direction transverse to the longitudinal direction, toward the longitudinal centerline of the belt separator system and away from the first and second electrodes.

13. A method of separating a mixture of particles which are admitted into a separation chamber having an elongated dimension, the elongated dimension being long compared to a spacing between a pair of opposing electrode surfaces, an electric field being imposed between the opposing electrode surfaces and the mixture of particles being conveyed in two streams in opposite directions between the opposing electrode surfaces, the mixture of particles being mechanically conveyed along the elongated dimension by a conveying member that is permeable to the mixture of particles and having a leading deflective surface at a number of locations on the conveying member that is adapted to impart velocity components to the mixture of particles in a direction both parallel to the opposing electrode surfaces and perpendicular to the opposing electrode surfaces.

14. The method of claim 13, wherein each leading deflective surface is disposed on the conveying member to be adjacent to one of the electrode surfaces and any point on each leading deflective surface forms an acute angle with respect to the adjacent electrode surface.

15. The method of claim 14, wherein the perpendicular velocity component is directed away from the adjacent electrode surface.

16. The method of claim 14, wherein the angle is in the range of 10–60°.

17. The method of claim 14, wherein the angle is in the range of 15–45°.

18. The method of claim 13, wherein the conveying member in the process of imparting a perpendicular velocity component to the mixture of particles, experiences a reaction force which causes the conveying member to impinge upon the adjacent electrode surface.

19. The method of claim 18, wherein the reaction force is sufficient to prevent contact between different segments of the conveying member moving in opposite directions between the opposing electrode surfaces.

20. The method of claim 13, wherein the conveying member includes counter-current segments traveling in opposite directions.

21. The method of claim 20, wherein the counter-current segments bow away from a longitudinal centerline between the countercurrent segments of the conveying member.

22. The method of claim 13, wherein the conveying member is an endless belt of open grid construction.

23. The method of claim 13, wherein the mixture of particles are moved by the leading deflective surface of the conveying member away from the opposing electrode surfaces and toward a longitudinal centerline between the opposing electrode surfaces.

24. A method of separating different components of a mixture in a separation chamber comprising the steps of:

a. admitting said mixture into the separation chamber, said separation chamber having confronting surfaces spaced more closely than respective lengths of said confronting surfaces;

b. impressing a separation influence toward at least one of said confronting surfaces of said separation chamber;

c. separating said different components of said mixture in the direction of said separation influence according to their relative influenceability to said separation influence;

d. mechanically moving components of like net influenceability near each other in streams moving transversely to said separation influence, said streams being in communication parallel to said separation influence so as to transfer a portion of at least one of said streams to another of said streams by virtue of the continued action of said separation influence as said streams progress transversely to said separation influence;

e. removing separated streams from said separation chamber; and wherein said streams are mechanically moved by an endless transport belt, said endless transport belt being permeable to the different components and having leading deflective surfaces that impart a velocity component to the different components that is perpendicular to said confronting surfaces and that enhances the separating of the different components by the separation influence.

25. The method claim 24, wherein a first portion and a second portion of said endless transport belt move countercurrently through said separation chamber, and wherein said leading deflective surfaces are adapted to impart the velocity component to the different components in a direction transverse to the movement of said belt, so that said different components are directed toward a center region between said first portion and said second portion of said endless transport belt.

* * * * *